US007219641B2

(12) United States Patent
Weinkauf

(10) Patent No.: US 7,219,641 B2
(45) Date of Patent: May 22, 2007

(54) PISTON FOR INTERNAL COMBUSTION ENGINES

(75) Inventor: Dieter Weinkauf, Stuttgart (DE)

(73) Assignee: Mahle GmbH, Stuttgart (DE)

( * ) Notice: Subject to any disclaimer, the term of this patent is extended or adjusted under 35 U.S.C. 154(b) by 173 days.

(21) Appl. No.: 10/515,669

(22) PCT Filed: May 20, 2003

(86) PCT No.: PCT/DE03/01629

§ 371 (c)(1),
(2), (4) Date: Nov. 23, 2004

(87) PCT Pub. No.: WO03/100238

PCT Pub. Date: Dec. 4, 2003

(65) Prior Publication Data

US 2005/0166886 A1 Aug. 4, 2005

(30) Foreign Application Priority Data

May 24, 2002 (DE) ..... 102 22 938

(51) Int. Cl.
*F02F 3/00* (2006.01)

(52) U.S. Cl. ..... 123/193.6

(58) Field of Classification Search ..... 123/193.6; 92/220

See application file for complete search history.

(56) References Cited

U.S. PATENT DOCUMENTS 3,141,231 A 7/1964 Davies et al.

(Continued)

FOREIGN PATENT DOCUMENTS

DE 26 47 250 4/1978

(Continued)

OTHER PUBLICATIONS

Hütte: "Des Ingenieurs Taschenbuch" 1955, Wilhelm Ernst & Sohn, Berlin XP00O225734 p. 144 Paragraph 4—p. 145, Paragraph 6, Enclosed.

*Primary Examiner*—Marguerite McMahon
(74) *Attorney, Agent, or Firm*—Collard & Roe, P.C.

(57) ABSTRACT

The invention relates to a piston for internal combustion engines comprising a lower part which forms the shaft area and also comprising a piston upper part which is connected thereto by means of expandable screws and which forms the bottom and a ring area wherein the expanding screws in the piston upper part (1) are disposed on pressure pieces engaging in the respective bores in the lower piston part (1) and wherein the respective disposition between the pressure piece and the lower piston part (1) occurs via inclined adjacent surfaces. The aim of the invention is to invent a piston which is easy to produce, which in relation to prior art enables improved introduction of forces for the connection of the piston part to the piston. According to the invention, this is achieved by virtue of the fact that the bearing surface of the lower piston part (1) for the pressure piece (2) corresponds to the surface of an elongate rotation ellipsoid of general formula $x^2/a^2+y^2/a^2+z^2/c^2=1$, wherein x, y and z define the co-ordinate axis and a and c define the semi axis whereby a<c, such that the co-ordinate axis z of the elongate rotation ellipsoid corresponds to the axis of the respective bore for receiving the pressure piece (2) and such that the bearing surface of the pressure piece (2) corresponds to a sphere of general formula $X^2+y^2+Z^2=r_k^2$, whereby $r_k$<a.

1 Claim, 3 Drawing Sheets

Figure 1:
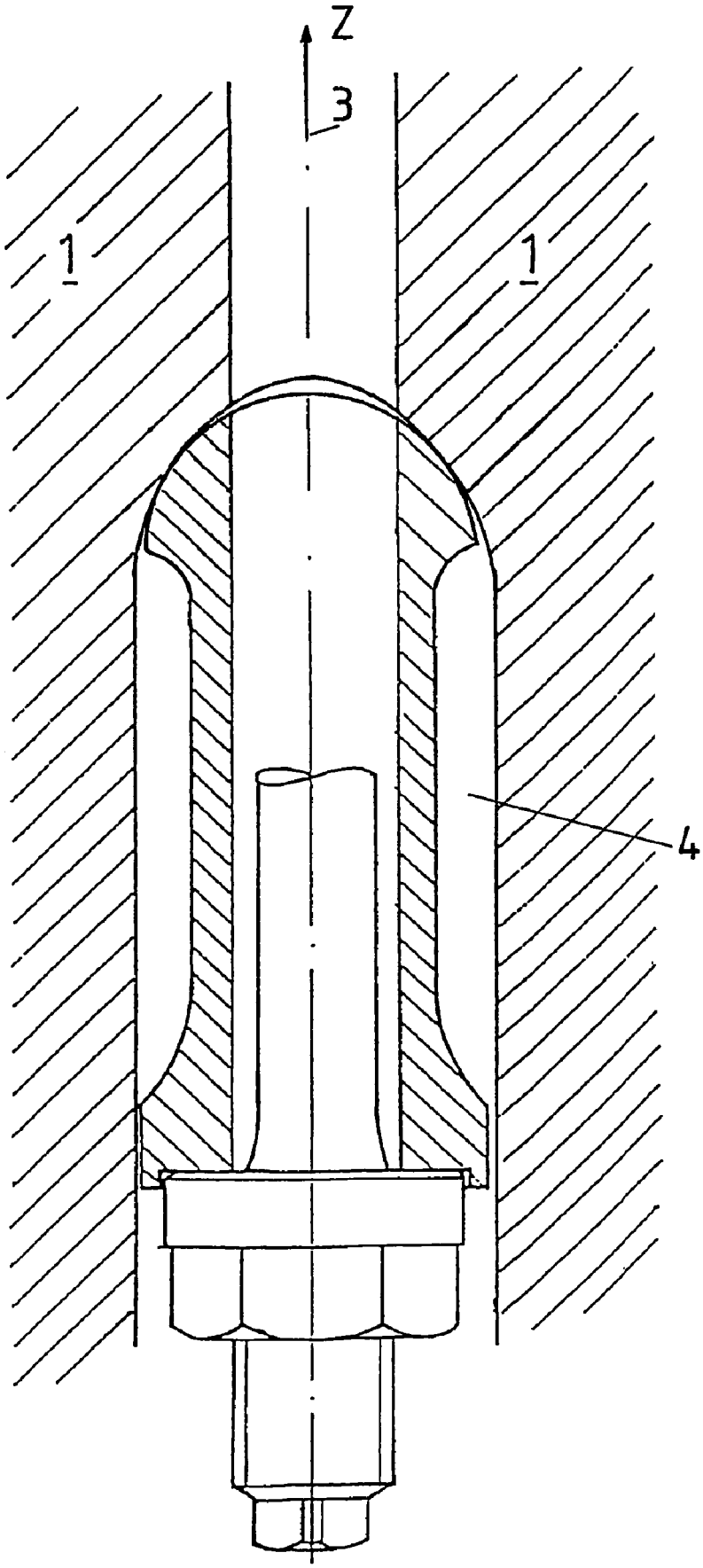

U.S. PATENT DOCUMENTS 4,185,544 A * 1/1980 Kolar ..... 92/220
6,164,261 A * 12/2000 Kruse ..... 123/193.6
6,182,630 B1 * 2/2001 Zhu et al. ..... 123/193.6

FOREIGN PATENT DOCUMENTS

DE 40 00 846 7/1991
FR 1 209 949 3/1960
GB 451 540 8/1936
GB 2239927 A * 7/1991

* cited by examiner

PISTON FOR INTERNAL COMBUSTION ENGINES

CROSS REFERENCE TO RELATED APPLICATIONS

Applicant claims priority under 35 U.S.C. §119 of German Application No. 102 22 938.4 filed on May 24, 2002. Applicant also claims priority under 35 U.S.C. §365 of PCT/DE03/01629 filed on May 20, 2003. The international application under PCT article 21(2) was not published in English.

The invention relates to a piston for internal combustion engines, in accordance with the preamble of claim 1.

Such pistons of this type are known, for example, from DE 26 47 250 C3 or DE 40 00 846 C2. In the case of these pistons, the contact surfaces of the anti-fatigue sleeve and of the piston, at which the anti-fatigue sleeve and the piston touch one another, are only very slightly inclined relative to the plane that runs normal to the longitudinal piston axis. The incline of the accommodation surface on the piston side, however, has advantages only in terms of processing technology, in this connection, and is therefore only as great as required to achieve good processing. In this connection, the slant is achieved by means of a ring-shaped spherical concave section, in each instance, whereby this section makes a transition into the wall of the bore provided for the anti-fatigue sleeve, in each instance, by way of a separate transition radius. The contact surface of the related anti-fatigue sleeve, in each instance, is correspondingly convex in these cases, in which the piston-side accommodation surface is configured to be concave. The curvature of the two contact surfaces, in this connection, is different, in each instance, in that in the cold state, a ring gap that widens towards the outside results between the contact surfaces. The size of the ring gap is designed in such a manner that in the biased state, it makes contact without a gap, under the same bias.

In DE 26 47 250 C3, it is proposed, in order to avoid excess stress on the interior region of the bore, i.e. in concrete terms, of the inner edge of the contact surface for the anti-fatigue sleeve, to lay the center points of the radii of curvature of the circular convex contact surface of the anti-fatigue sleeve next to the longitudinal axis of the anti-fatigue sleeve, in contrast to that of those of the concave counter-surface of the lower piston part. In this way, the first contact between the anti-fatigue sleeve and the lower piston part is supposed to take place in the center region of the contact surface between the anti-fatigue sleeve and the lower piston part, viewed radially. When the screw is tightened, the contact surfaces that lie against one another then obtain full contact, starting from a center, first contact line.

In the embodiment according to DE 40 00 846 C2, the contact surface of the piston for the anti-fatigue sleeve makes a transition, tangentially, into the mantle surface of the bores that contain the anti-fatigue sleeve, by way of a radius of curvature R1, the value of which is greater than the difference of the radii of the bores located there, and those at the inside circumference of the piston-side anti-fatigue sleeve contact. In this way, the result is supposed to be achieved that by means of a greater incline, in total, of the contact surface between the anti-fatigue sleeve and the counter-bearing of the piston, a greater force transfer surface is achieved between the anti-fatigue sleeve and the piston-side counter-bearing, with a pre-determined diameter of the bore that accommodates the anti-fatigue sleeve.

It is true that the contact forces between a specific region of the contact surface become approximately equally great as a result of this embodiment, in the biased state, but it is a disadvantage that this region still lies very close to the edge of the accommodation bore of the anti-fatigue sleeve, so that the risk of stress cracks due to excess stress in the piston cannot be precluded.

It is the task of the invention to create a piston of the type stated, which can be produced in simple manner and which permits an improved introduction of force from the connecting piston part to the piston, as compared with the known state of the art.

This task is accomplished by means of the characteristics of the single claim.

The fundamental advantage consists in the precisely defined contact region of the contact surface between the pressure piece and the counter-bearing of the piston, as a result of which the introduction of force into the lower piston part is made possible, without cracks or deformations of the piston coming about. When tightening the anti-fatigue bolt, in particular the gap between the pressure piece and the contact surface, measured at the piston diameter, is closed radially from the outside to the inside, so that the bore for accommodating the pressure piece, which is present on the lower piston part, is relieved of stress. In this way, plastic deformations are practically excluded. Likewise, the transition region of the contact surface from the elliptical to the cylindrical part of the bore for accommodating the pressure piece is decisively relieved of stress by means of the reduced lever effect of the contact force.

An exemplary embodiment is shown in the drawings.

Figure 2:
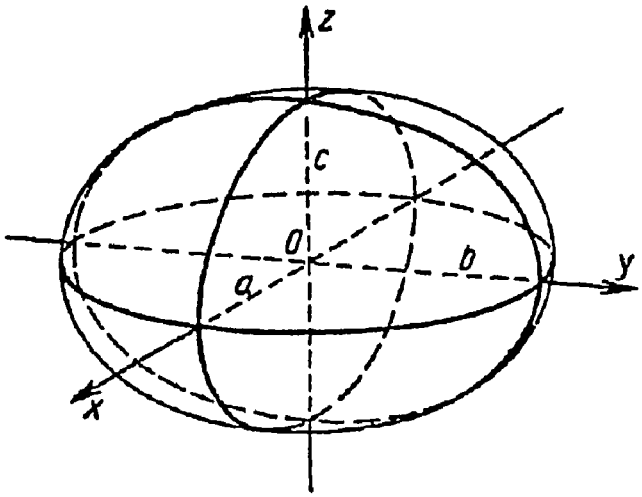
Figure 3:
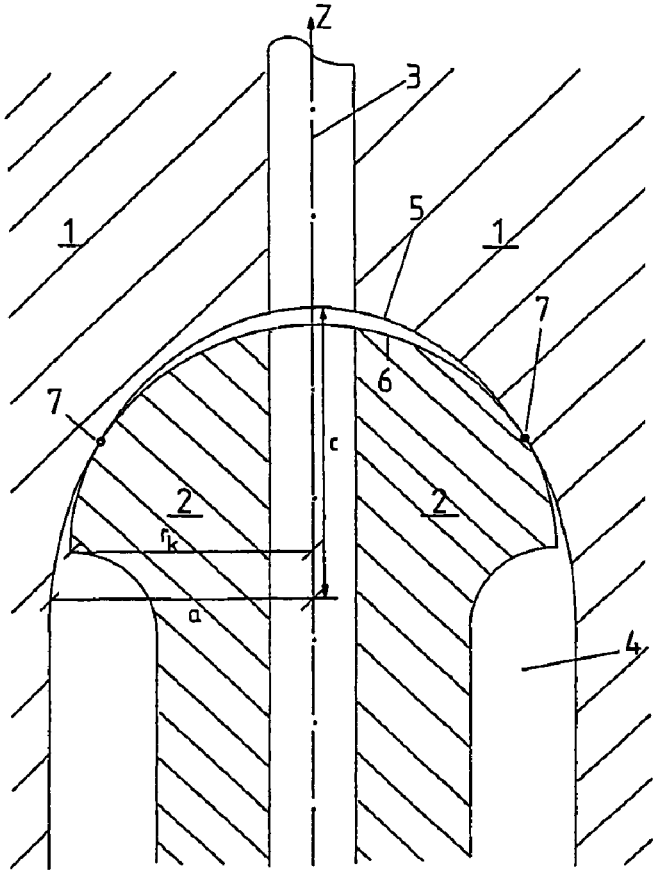

The figures show:

FIG. 1 a cross-section through a pressure piece mounted in an accommodation bore of a piston;

FIG. 2 the arrangement/configuration of the contact surface of the lower piston part, according to the invention;

FIG. 3 a detail view of the contact surfaces according to FIG. 1.

Figure 4:
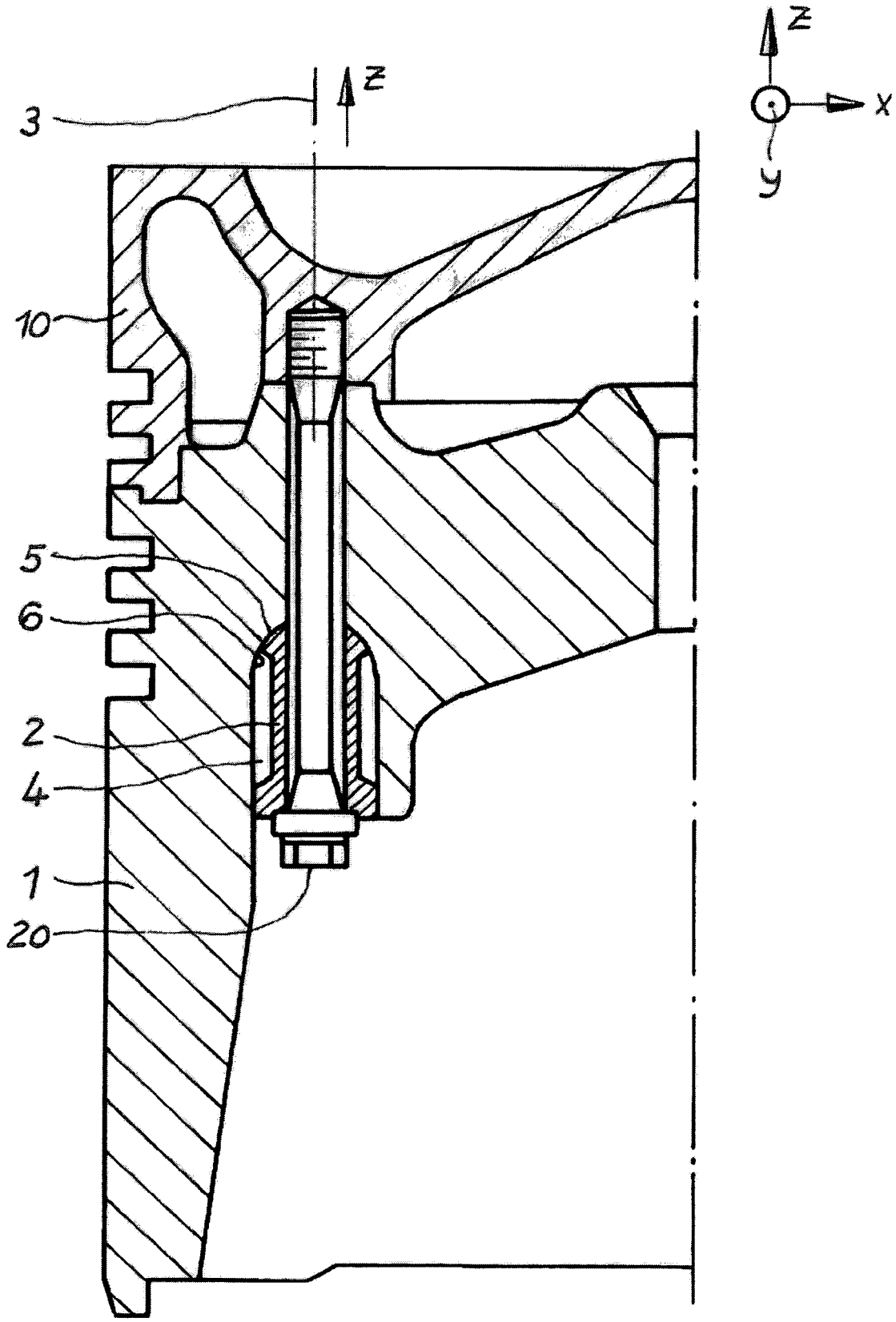

FIG. 4 a detail of a half of a complete piston according to the invention.

As shown in FIG. 4, the piston according to the invention has an upper piston part 10 and a lower piston part 1. Lower piston part 1 has a bore 4 provided with a bore axis, i.e. an anti-fatigue bolt 20 with an axis 3, in which a pressure piece 2 having a contact surface 6 shaped as a sphere, having the radius $r_k$, is disposed. The bore itself has the radius a and is configured, in the end region, in the direction of the spatial coordinate z, as an elongated rotation ellipsis in accordance with the formula stated in claim 1, having the large semi-axis c. In this connection, the coordinate axis z of the elongated rotation ellipsoid coincides with the axis 3 of the bore for accommodating the pressure piece 2. In accordance with the design of the contact surfaces, in terms of size, the spherical contact surface 6 of the pressure piece 2 and the elliptical contact surface 5 of the bore in the piston 1 therefore touch one another in the un-biased state, at the points indicated with 7. These lie very close to the bore diameter, radially towards the outside. By tightening the anti-fatigue bolt, they migrate radially inward along the elliptical contact surface 5, until the gap is closed. This results in optimal force introduction into the lower piston part, without crack formation or plastic deformation at the piston.

The invention claimed is:

1. A piston for internal combustion engines, comprising:

a lower part that forms a skirt region, and an upper piston part that forms a piston head and a ring region;

anti-fatigue bolts connecting said upper piston part with said lower piston part;

compression sleeves enaged in bores of the lower piston part, each bolt contacting one end of one of said compression sleeves, wherein a contact surface of each compression sleeve contacts a contact surface of the lower piston part;

wherein the contact surface of the lower piston part has a shape of spheroid having the general formula $$x^2/a^2+y^2/a^2+z^2/c^2=1,$$

wherein x, y, and z define coordinate axes of the spheroid and a and c define a radius of the bore and of a semiaxis of the spheroid in a direction z, where a<c;

wherein the coordinate axis z of the spheroid corresponds with longitudinal axii of the antifatigue bolt, a longitudinal axis of the bore and a longitudinal axis of the compression sleeve; and wherein the contact surface of the compression sleeve has the shape of a sphere having the general formula $x^2+y^2+z^2=r_k^2$, whereby $r_k$ is a radius of the sphere and $r_k<a$.

* * * * *